US006199285B1

(12) United States Patent
Sheehan

(10) Patent No.: US 6,199,285 B1
(45) Date of Patent: Mar. 13, 2001

(54) CAMPING FLATWARE

(76) Inventor: Brendan Sheehan, 503 N. VanBuren St., Bay City, MI (US) 48708

( * ) Notice: Subject to any disclaimer, the term of this patent is extended or adjusted under 35 U.S.C. 154(b) by 0 days.

(21) Appl. No.: 09/510,402

(22) Filed: Feb. 22, 2000

(51) Int. Cl.[7] ..... A47J 43/28
(52) U.S. Cl. ..... 30/324; 30/322; 16/436
(58) Field of Search ..... 30/142, 322–328, 30/153, 155, 340; 16/422, 436; 81/177.6; D7/664

(56) References Cited

U.S. PATENT DOCUMENTS

| | | | | |
|---|---|---|---|---|
| 41,338 | | 1/1864 | Godfrey . | |
| 558,503 | | 4/1896 | Marbury . | |
| 1,827,118 | | 10/1931 | Stephens . | |
| 1,870,403 | * | 8/1932 | Ceffing | 81/177.6 X |
| 2,803,059 | * | 8/1957 | Murdock et al. | 30/324 |
| 2,841,869 | * | 7/1958 | Levine | 30/322 |
| 3,448,748 | | 6/1969 | Walrave . | |
| 4,052,808 | | 10/1977 | Crabtree . | |
| 4,539,751 | | 9/1985 | Chan . | |
| 4,706,696 | | 11/1987 | Gillis . | |
| 4,979,531 | | 12/1990 | Toor et al. . | |
| 5,206,998 | * | 5/1993 | Oriente et al. | 30/142 |
| 5,251,758 | | 10/1993 | Kolacek . | |
| 5,479,708 | * | 1/1996 | Thomas | 30/324 X |
| 5,735,050 | * | 4/1998 | Hsieh | 30/324 |
| 6,047,476 | * | 4/2000 | Stein et al. | 30/324 |

* cited by examiner

*Primary Examiner*—Douglas D Watts
(74) *Attorney, Agent, or Firm*—Reising, Ethington, Barnes, Kisselle, Learman, McCulloch, P.C.

(57) ABSTRACT

The foldable flatware utensil includes a shank with an integral spoon bowl, knife or fork. An elongated handle has an end that is telescopically connected to an end of the shank. A bore in the shank is aligned with a bore in the handle when assembled for use. A line has one end anchored in the bore in the shank. Another end of the line holds a portion of the line in the bore in the shank. If the line is elastic, the handle is urged toward the shank for use and stretches to permit the handle to be disengaged from the shank and folded for storage. If the line is inelastic, a sleeve is retained on the line and fixed in the bore in the handle. When removing the handle from the use position, a portion of the line is pulled through the sleeve and permits the handle to be folded for storage. A detent maintains a connection between the handle and the shank if needed.

14 Claims, 3 Drawing Sheets

FIG-1
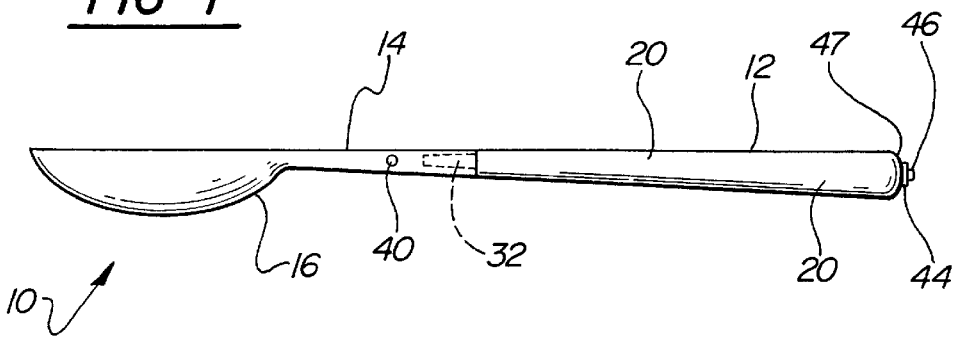
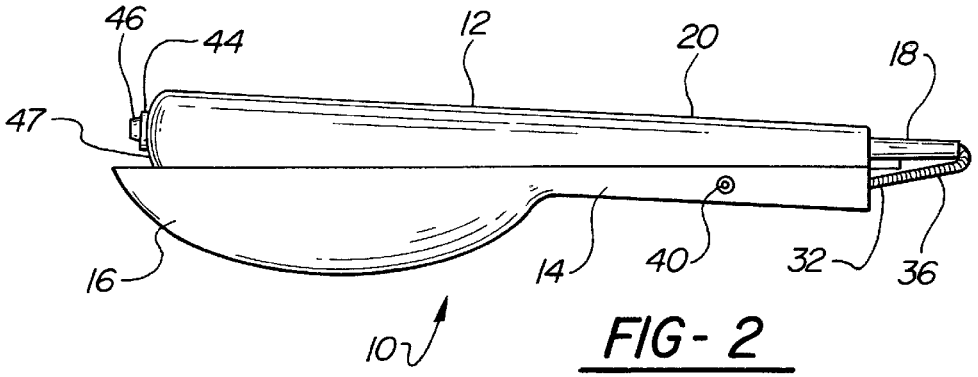
FIG-2
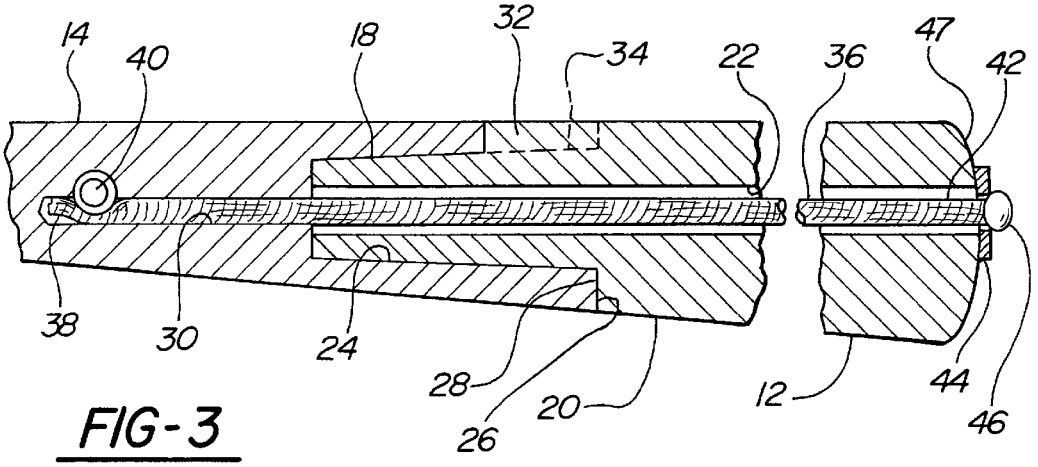
FIG-3

CAMPING FLATWARE

TECHNICAL FIELD

This invention is in flatware including knives, forks and spoons with removable handles for backpacking and other camping.

BACKGROUND OF THE INVENTION

Backpacker takes steps to obtain equipment that is lightweight and compact. Weight is important because a person can only carry a limited total weight. A piece of critical equipment that is a few ounces lighter than a comparable piece of equipment maybe worth substantially more to a backpacker because it allows him to carry more food and travel for a longer period of time. Lightweight equipment can also permit a backpacker to reduce the total weight carried and travel a longer distance each day.

The volume of the equipment and supplies carried by a backpacker is also very important. Backpacks have a limited volume for receiving equipment and supplies. Some equipment can be attached to the outside of a backpack. Equipment on the outside of a backpack may be exposed to the elements and can be lost. Increasing the size of a total package carried by a backpacker increases the chances that equipment on the outside of the backpack will catch on trees, tree limbs, bushes, vines, rocks and other objects.

A large backpack or a backpack with gear attached to its outer surfaces has increased inertia forces about its center of gravity. These forces are transferred to a person carrying the backpack making it more difficult to maintain balance. To maintain balance, a person with a backpack having high inertia forces slows down to move with care and reduce the effort required to stabilize a backpack.

Backpackers, when traveling extended distances, carry cooking equipment. The cooking equipment frequently includes a set of pots and pans with small pots that nest within larger pots and a small heating source. Full size flatware is generally to large to fit in the small pots.

Plastic flatware is generally unsuitable for backpacking. There is too much breakage. The pieces will not take the heat during cooking. Plastics generally create too much trash that has to be carried to an approved disposal sight.

SUMMARY OF THE INVENTION

The flatware utensil has a food treatment and conveying device that is integral with a shank. A handle is releasably attached to the shank when in an assembled use position and is released from the shank when in an disassembled storage position. Cooperating surfaces on the shank and the handle limit rotation of the handle relative to the shank when in the use position. Shank and handle axial bores are in alignment with each other when in the use position. A line has a first end anchored in the shank axial bore and a second end anchored in the handle. A line permits disengagement of the handle from the shank for storage but limits their separation.

The line can be an elastic member or a cable with a fixed length. A detent can be provided to hold the handle in a use position.

Foldable flatware can be carried inside cooking pots or other containers. The line or cable prevents handles from being separated from the working end of the flatware and lost.

BRIEF DESCRIPTION OF THE DRAWINGS

The presently preferred embodiment of the invention is disclosed in the following description and in the accompanying drawings, wherein:

FIG. 1 is a side elevational view of a utensil in a use position;

FIG. 2 is an enlarged side view of a utensil in a folded position for storage;

FIG. 3 is an enlarged sectional view showing the connection between the utensil handle and a utensil shank;

DESCRIPTION OF THE PREFERRED EMBODIMENTS

Figure 4:
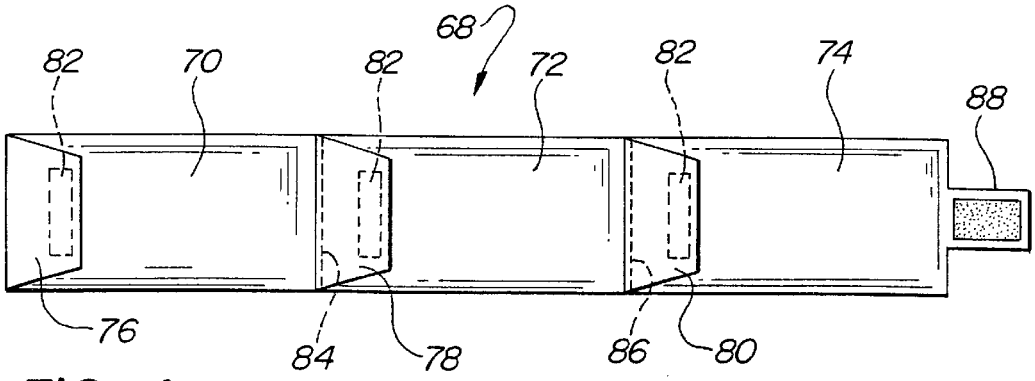
FIG. 4 is a carrying bag for a folded knife, fork and spoon.

The foldable flatware utensil 10 shown in FIG. 1 is a spoon. The utensil 10 has a handle 12, a shank 14 and a spoon bowl 16 integral with the shank. The shank 14 could have an integral knife blade or fork tines in place of the bowl 16. The handle 12 includes a frustoconical end 18 with a smaller outside diameter than the adjacent portion of the gripping surface 20 of the handle. A central bore 22 passes through the handle 12.

The shank 14 has a conical bore 24 that extends from an end surface 26 toward the bowl 16. The conical bore 24 receives the frustoconical end 18 of the handle 12. A stop surface 28 on the handle 12 contacts the end surface 26 on the shank 14. A bore 30 in the shank 14 extends further into the shank 14 than the conical bore 24.

The frustoconical end 18 of the handle 12 is easy to insert into the conical bore in the shank 14 and forms a rigid connection. If desired the bore 24 and the end 18 could both be cylindrical. A tight fit between the bore 24 and the end 18 would be required to provide a satisfactory connection.

A key 32 is provided on the handle and is received in a slot 34 in the shank 14 to prevent the handle from rotating relative to the shank. The handles 12 are generally noncircular so that a user knows if the utensil 10 is held in the proper orientation. However utensils 10 with round handles 12 can be used. Rotation of the shank relative to the handle 12 would not be acceptable however.

The key 32 in the slot 34 could be replaced by a number of structures that would prevent rotation of the shank 14 relative to the handle 12. There could for example be a pin on one member that is received in a bore in the other member. Both the pin and the bore would be spaced to one side of an axis of rotation of the handle 12 relative to the shank 14. A spring loaded detent could also be used.

An elastic line 36 extends the combined length of the central bore 22 and the bore 30 in the shank 14. An inside end 38 of the elastic line 36 is anchored in bore 30 by a threaded fastener 40. An outside end 42 of the elastic line 36 passes through a retainer disk 44 and is held in place by a knob 46. The elastic line 36 is under tension as shown in FIG. 3 to hold the end 18 of the handle 12 in the bore 24. The retainer disk 44 is urged toward the free end 47 of the handle 12 by the line 36. The elastic line 36 has sufficient elasticity to permit the handle 12 to be disengaged from the bore 24 in the shank and folded into the position shown in FIG. 2. The retainer disk 44 is free to rotate relative to the handle 12 to protect the line 36 from damage due to excessive twisting.

Figure 7:
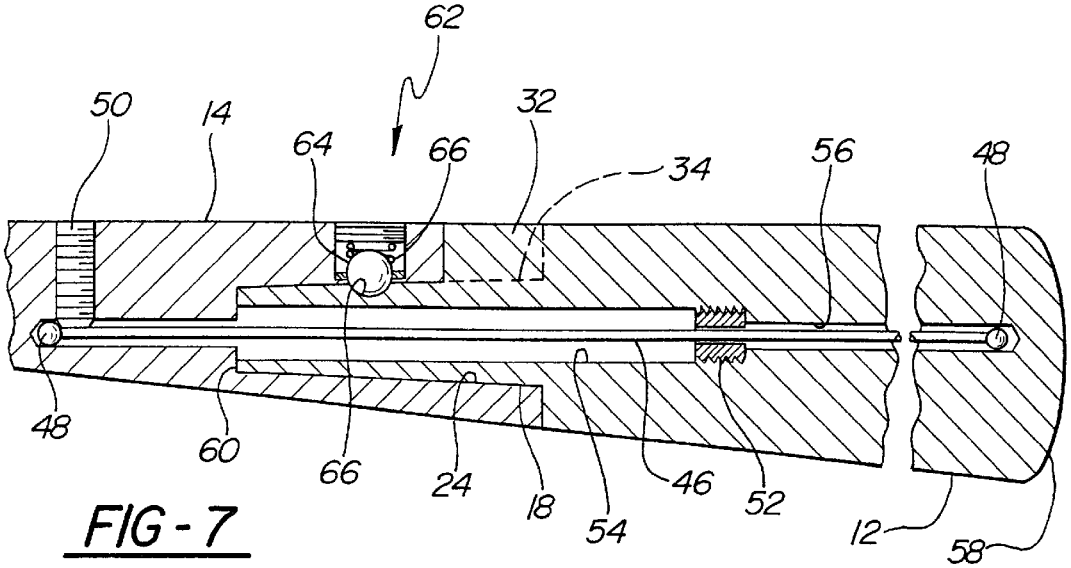
FIG. 7 is a sectional view similar to FIG. with an alternate construction.

The elastic line 36 can be replaced by an inelastic cable 46 as shown in FIG. 7. The cable 46 could be a piano wire or a multi strand woven member. A retainer ball 48 is provided on each end of the cable 46. The retainer ball 48 on the end of the cable 46 in the shank 14 is held in place by a threaded fastener bolt 50. A sleeve 52 is captured on cable 46 between the two retainer balls 48. The sleeve 52 is screwed into a threaded portion of the handle bore 54. An end of the cable 46 and one of the balls 48 in the passage 56 has sufficient length to permit removal of the handle 12 from the shank 14 when an inelastic cable 46 is used. The passage 56 does not extend out of the free end 58 of the handle 12. The sleeve 52 could be adjacent to the end 60 of the handle 12 if desired. However, weight is reduced somewhat by moving sleeve 52 toward the free end 58 as shown in FIG. 7.

The inelastic cable 46 does not hold the handle 12 in the shank 14 like the elastic line 36 described above. A ball detent assembly 62 is therefore provided to maintain engagement of the handle 12 and the bore 24 in the shank 14. The ball detent 62 includes a ball 64 received in a depression 65 in the frustoconical end 18 and a coil spring 66 that biases the ball toward the depression. The key 32 and the slot 34, for preventing rotation of the handle 12 and the shank 14 relative to each other is shown in FIG. 7. However, the detent assembly 62 will also prevent unintended rotation of the handle 12 relative to the shank 14. With the detent assembly 62, the key 32 and the slot 34 are not required. The key 32 and the slot 34 may in some circumstances reduce the force on the detent assembly 62 and thereby maintain the connection between the handle 12 and the shank 14.

A threaded connection between the handle 12 and the shank 14 may be employed when the inelastic cable 46 shown in FIG. 7 is used. The cable 46 is free to rotate in the sleeve 52. When screwing a threaded handle 12 unto the threaded shank 16, the cable 46 will rotate relative to the sleeve 52 and will not interfere with handle rotation.

Spoon bowls 16 may have slots formed in its free end. These slots form tines that permit the utensil to function as a fork as well as a spoon.

Figure 5:
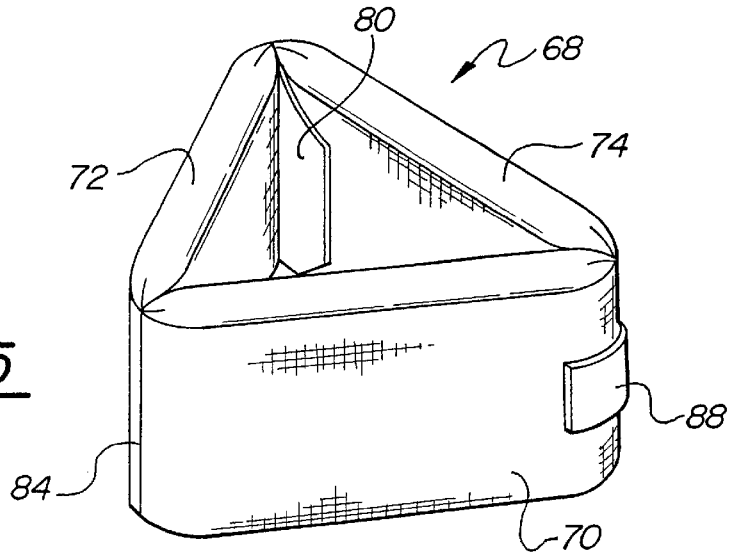
FIG. 5 shows the carrying bag in a position to fit in a pot with room to nest other equipment in the center.
Figure 6:
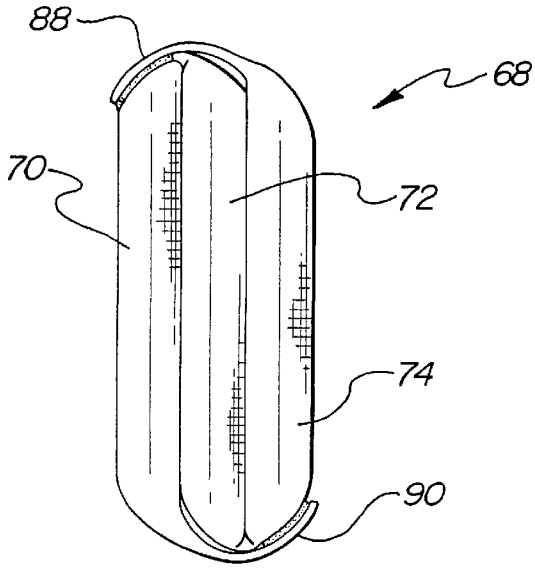
FIG. 6 is an end view of the carrying case folded into a rectangular package.

The carrying bag 68 for the flatware utensils 10 is a lightweight bag with three compartments 70, 72 and 74. Closure flaps 76, 78 and 80, with hook and loop fasteners 82 hold a folded utensil 10 in each compartment. The center compartment 72 is connected to the compartment 70 at 84 and to the compartment 74 at 86. A hook and loop fastener flap 88 is secured to the free end of the compartment 74. Another hook and loop fastener flap 90 is connected to the free end of the compartment 70. The flap 88 locks the compartment 70, 72 and 74 in a triangular configuration as shown in FIG. 5. The compartments 70, 72 and 74 can also be held in an accordion folded configuration as shown in FIG. 6 by the flaps 88 and 90.

The disclosed embodiment is representative of a presently preferred form of the invention, but is intended to be illustrative rather than definitive thereof. The invention is defined in the claims.

I claim:

1. A flatware utensil comprising;

a shank;

a food treatment and conveying device integral with the shank;

a handle releasably attached to the shank when in an assembled use position and released from the shank wherein a disassembled storage position;

at least one pair of cooperating surfaces on the handle and the shank that limit rotatable movement of the handle relative to the shank when in the assembled use position;

a shank axial bore in the shank;

a handle axial bore in the handle that is aligned with the shank axial bore when in the assembled use position;

a line having a first end portion positioned in the shank axial bore and anchored to the shank; and a second end passing into the handle axial bore and anchored to the handle and wherein the line permits the handle to be released from the shank and moved to a disassembled storage position.

2. A flatware utensil as set forth in claim 1 wherein the handle includes an end projection that is telescopically received in a bore in the shank when in the assembled use position.

3. A flatware utensil as set forth in claim 1 wherein the line is a resilient member, the at least one pair of cooperating surfaces includes a handle stop surface that contacts a shank end surface to limit axial movement of the handle toward the shank, and wherein the resilient member urges the handle stop surface toward the shank end surface.

4. A flatware utensil as set forth in claim 3 wherein the handle axial bore extends through the handle, the line passes through a retainer disk, the retainer disk is captured on the line by a line end knob, and the retainer disk is urged into contact with a free end of the handle by the line.

5. A flatware utensil as set forth in claim 4 wherein the retainer disk can be rotated relative to the free end of the handle.

6. A flatware utensil as set forth in claim 1 wherein the handle includes a conical end projection that is telescopically received in a conical bore in the shank when in the assembled position.

7. A flatware utensil as set forth in claim 1 wherein the line is a flexible member with a fixed length.

8. A flatware utensil as set forth in claim 7 including a sleeve with a sleeve bore that receives the line, a retainer ball on the second end of the line that retains the sleeve on the line, and a threaded sleeve surface in engagement with a threaded section of the handle axial bore to anchor the handle to the line.

9. A flatware utensil as set forth in claim 8 wherein a portion of the handle axial bore between the sleeve and the free end of the handle telescopically receives the second end of the line when the handle is in the assembled use position.

10. A flatware utensil as set forth in claim 8 wherein the handle axial bore has an open end and a closed end.

11. A flatware utensil comprising:

a shank;

a food treatment and conveying device integral with the shank;

a shank bore in the shank;

a handle releasably attached to the shank when in an assembled use position and released from the shank when in a disassembled storage position;

at least one pair of cooperating surfaces on the handle and the shank that rotatably and axially retain the handle relative to the shank when in the assembled use position;

a handle bore in the handle that is aligned with the shank bore when in the assembled use position;

a flexible cable having a fixed length, a first end anchored in the shank bore, and a second end telescopically received in the handle bore;

a retainer sleeve secured in the handle bore and having a retainer sleeve passage that telescopically receives the flexible cable; and a retainer ball on the second end of the flexible cable that cooperates with the retainer sleeve to limit telescopic movement of the flexible cable from the handle bore.

12. A flatware utensil as set forth in claim 11 wherein the at least one pair of cooperating surfaces includes a ball detent assembly.

13. A flatware utensil as set forth in claim 11 wherein the at least one pair of cooperating surfaces includes a conical projection that is received in a conical bore.

14. A flatware utensil as set forth in claim 13 wherein the conical projection is on the handle and the conical bore is in the shank.

* * * * *

UNITED STATES PATENT AND TRADEMARK OFFICE

CERTIFICATE OF CORRECTION

PATENT NO. : 6,199,285 B1
DATED : March 13, 2001
INVENTOR(S) : Brendan Sheehan

It is certified that error appears in the above-identified patent and that said Letters Patent is hereby corrected as shown below:

Column 2,
Line 12, after "FIG." insert -- 3 --;
Line 56, change "46" ro -- 49 --.

Signed and Sealed this

Fourteenth Day of August, 2001

*Attest:*

Nicholas P. Godici

*Attesting Officer*

NICHOLAS P. GODICI
*Acting Director of the United States Patent and Trademark Office*